United States Patent [19]

Sato et al.

[11] Patent Number: 4,755,275

[45] Date of Patent: Jul. 5, 1988

[54] ELECTRICAL INSULATING OIL

[75] Inventors: Atsushi Sato, Tokyo; Yoshikazu Murai, Yokohama; Tatsuo Yamaguchi, Hino; Kanji Mochizuki; Kunio Sugisawa, both of Yokohama, all of Japan

[73] Assignee: Nippon Petrochemicals Company, Limited, Tokyo, Japan

[21] Appl. No.: 698,327

[22] Filed: Feb. 5, 1985

[30] Foreign Application Priority Data

| | | | |
|---|---|---|---|
| Feb. 10, 1984 | [JP] | Japan | 59-21849 |
| Feb. 10, 1984 | [JP] | Japan | 59-21850 |
| Feb. 14, 1984 | [JP] | Japan | 59-24512 |

[51] Int. Cl.[4] ..... C10L 1/10; H01B 3/22

[52] U.S. Cl. ..... 208/14; 585/6.3; 585/6.6; 252/570; 252/573; 252/574

[58] Field of Search ..... 208/14; 585/6.3, 6.6; 252/570, 573, 574

[56] References Cited

U.S. PATENT DOCUMENTS

| | | | |
|---|---|---|---|
| 2,810,769 | 10/1957 | Sanford et al. | 585/63 |
| 2,810,770 | 10/1957 | Sanford et al. | 585/63 |
| 3,145,161 | 8/1964 | Anderson et al. | 208/14 |
| 3,252,887 | 5/1966 | Rizzuti | 208/14 |
| 3,502,567 | 3/1970 | Mills et al. | 208/14 |
| 3,617,473 | 11/1971 | Lipscomb | 208/14 |
| 3,681,233 | 8/1972 | Mills et al. | 208/14 |
| 3,844,931 | 10/1974 | Ishiguro et al. | 208/14 |
| 3,928,168 | 12/1975 | Mills et al. | 208/14 |
| 4,033,854 | 7/1977 | Ohmori et al. | 208/14 |
| 4,069,166 | 1/1978 | Masunaga et al. | 585/6.6 |
| 4,170,543 | 10/1974 | Lipscomb et al. | 208/14 |
| 4,175,278 | 11/1979 | Sato et al. | 208/14 |
| 4,442,027 | 4/1984 | Sato et al. | 252/570 |

*Primary Examiner*—Carl F. Dees
*Assistant Examiner*—Helane Myers
*Attorney, Agent, or Firm*—Scully, Scott, Murphy & Presser

[57] ABSTRACT

A process for preparing an electrical insulating oil comprising a reaction product having a boiling range of higher than 260° C. obtained by treating a hydrocarbn feed at a reaction temperature in the range of 0° to 300° C. in liquid phase in the presence of an acid catalyst, said hydrocarbon feed comprising a distillate from a thermal-cracked oil obtained in a thermal cracking process for thermally cracking a petrolic heavy residual oil at a temperature not lower than 400° C. and not exceeding 700° C., said distillate consisting mainly of hydrocarbons boiling in the range of 120° to 290° C. and said distillate containing at least 30 weight percent of paraffins and at least 10 weight percent of aliphatic olefins, and separating said reaction product from the resulting mixture containing at least said reaction product and unreacted hydrocarbons.

14 Claims, No Drawings

ELECTRICAL INSULATING OIL

BACKGROUND OF THE INVENTION

The present invention relates to an electrical insulating oil obtained by processing a distillate from a thermal-cracked oil obtained in a thermal cracking process using a petrolic heavy residual oil as a starting material.

Recently, because of the exhaustion of petroleum resorces, heavier crude oils have come to be used, thus giving rise to an increasing tendency of the amount of heavy oils by-produced such as residual oils in distillations. These heavy residual oils are of less industrial value by reason of their high viscosities or high sulfur and metal contents.

On the other hand, such heavy residual oils can be utilized in thermal cracking processes typified by coking, which may be the only utilization mode of those oils. By the heavy residual oil coking process is obtained a liquid substance, i.e., thermal-cracked oils, as well as coke and gas. Usually, the thermal-cracked oil distillates are obtained in large amounts by the heavy residual oil coking process.

Since the cracked oil distillates thus obtained in large amounts contain large amounts of unsaturated compounds and aliphatic hydrocarbons and do not have a sufficiently high octane number, they have heretofore not been used directly as gasoline base stocks for automobiles, for which purpose they are required to be further subjected to a reforming treatment such as a fluid catalytic cracking. At most, the distillates have been used as mere fuels for boilers, etc. Therefore, how to utilize such large amounts of thermal-cracked oil distillates is becoming a subject of discussion in the industrial world.

SUMMARY OF THE INVENTION

It is an object of the present invention to effectively utilize a distillate from a cracked oil obtained in a large amount as a by-product, for example, in the coking process which distillate has been found useful merely as fuel for boilers or the like, and to enhance the utilization value of heavy residual oils by-produced in large amounts typical of which is petroleum asphalt, by processing those heavy residual oils.

It is another object of the present invention to effectively utilize a high-boiling aromatic hydrocarbon distillate of little utilization value by-produced from a cracking apparatus for the production of ethylene.

According to the present invention, a hydrocarbon feed which comprise a distillate from a thermal-cracked oil obtained by thermally cracking a petrolic heavy residual oil at a temperature not lower than 400° C. and not exceeding 700° C. is treated with an acid catalyst, whereby there is obtained a liquid reaction product which is industrially useful as an electrical insulating oil.

Accordingly, the present invention resides in an electrical insulating oil comprising a reaction product having a boiling range of higher than 260° C. obtained by treating a hydrocarbon feed at a reaction temperature in the range of 0° to 300° C. in liquid phase in the presence of an acid catalyst, said hydrocarbon feed comprising a distillate from a thermal-cracked oil obtained in a thermal cracking process for thermally cracking a petrolic heavy residual oil at a temperature not lower than 400° C. and not exceeding 700° C., said distillate consisting mainly of hydrocarbons boiling in the range of 120° to 290° C. and said distillate containing at least 30 weight percent of paraffins and at least 10 weight percent of aliphatic olefins, and separating said reaction product from the resulting mixture containing at least said reaction product and unreacted hydrocarbons.

Further, the present invention resides in an electrical insulating oil comprising a hydrogenated reaction product obtained by hydrogenating selectively olefinic unsaturation present in the above reaction product.

The reaction product mentioned above has a boiling range of not only higher than 260° C. but also substantially higher than the boiling range of the hydrocarbons contained as the main component in said distillate used.

In U.S. Pat. No. 4,208,268 there is disclosed a process for treating a thermal-cracked by-product oil distillate with an acid catalyst to afford a product useful for an electrical insulating oil, etc. However, this distillate is obtained by a thermal cracking process for the production of lower olefins such as ethylene, and is rich in aromatics. Usually, heavy residual oils are not used as starting materials for such cracking. Besides, the cracking temperature is as high as not lower than 700° C. because lower olefins are to be produced.

In U.S. Pat. No.3,844,931 there is disclosed a method of producing a special solvent by reacting specific hydrocarbon fractions with a lower olefin of $C_2$ to $C_9$ in the presence of an acid catalyst. The starting hydrocarbon fraction are defined by a specific index determined from a calculation formula which includes boiling point and specific dispersion. Fractions inferred from this index are high boiling fractions having a high aromatics content. In fact, in the cited U.S. patent it is only fractions having high aromatics contents that are concretely disclosed as hydrocarbon fractions satisfying the above specific index. Therefore, not only the special solvent (also defined by a specific index) obtained by the cited U.S. patent, but also unreacted fractions are high in aromatics content.

On the other hand, in the present invention, from a cracked oil distillate having a low aromatics content there are obtained a high boiling fraction useful as an electrical insulating oil.

DESCRIPTION OF THE PREFERRED EMBODIMENTS

The petrolic heavy residual oils referred to herein indicate bottom residues in atmospheric distillation, vacuum distillation and thermal or catalytic cracking, and various residues in petroleum refining, for example, residual oils in extraction with furfural, propane, pentane, etc., residual oils in reformers, as well as mixtures thereof, in the ordinary sense in the petroleum refining industry.

In the thermal cracking process of the present invention, the cracking temperature should be not lower than 400° C. and should not exceed 700° C. If the cracking temperature is lower than 400° C., a thermal cracking will not occur, and if it exceeds 700° C., regardless of the cracking time, the resultant thermal-cracked oil will contain excess aromatic hydrocarbons which per se are highly reactive, thus permitting an easy production of high polymers such as resins in the treatment with an acid catalyst, and the proportion of aliphatic olefins boiling in the range of 120° to 290° C. will become too small. Therefore, such temperatures outside the above-defined temperature range are not desirable. A preferable cracking temperature range is from 400° to 600° C., more preferably from 400° to 550° C. The cracking time may vary, depending on the main purpose of the thermal cracking process such as, for example, the production of coke or the reduction in viscosity of the starting heavy oil. For example, the cracking time may be selected from the range of 10 seconds to 50 hours. The cracking may be performed in the presence of steam or other non-reactive gaseous medium. The cracking pressure usually is relatively low, that is, ranging from vacuum to 50 kg/cm$^2$ or so.

As typical examples of such thermal cracking process for heavy residual oils, mention may be made of the viscosity breaking process and the coking process, as described in the "Hydrocarbon Processing," Vol.61, No.9 (September 1982), pp.160–163.

The viscosity breaking process is a thermal cracking process mainly for lowering the viscosity of a feed material which is carried out under relatively mild cracking conditions while suppressing the formation of coke in a tubular heating furnace. It is classified into a coil type and a soaker type. Usually, the cracked oil leaving the cracking furnace is quenched for suppressing the formation of coke and the decomposition. As concrete processes are included the Lummus process and Shell process.

In the coking process, which is a petroleum coke producing process, are included the delayed coking process (e.g. UOP process, Foster Wheeler process, M. W. Kellogg process, Lummus process and CONOCO process) in which the petrolic heavy residual oil is once heated in a heating furnace for a relatively short time and then fed to a coke drum for forming an agglomerate coke over a relatively long period of time; the fluid coking process (e.g. Exxon process) in which the petrolic heavy residual oil is thermally cracked over a high-temperature fluidized coke; the flexicoking process (Exxon process) which comprises the combination of the fluid coking process with the resultant coke gasifying process; and the EUREKA process which carries out not only a thermal cracking but also steam stripping at a relatively low pressure such as atmospheric pressure to prepare pitch.

In the present invention, of the thermal cracking processes referred to above, the coking process is preferred because the sulfur and metal components in the petrolic heavy residual oil are concentrated into the resultant coke so the content of these impurities in the cracked oil is relatively small and therefore the refining even after the acid catalyst treatment is relatively easy and also because the content of high-boiling aliphatic olefins is relatively large. Above all, the delayed coking process has been adopted on large scales because an agglomerate coke is obtained which is useful as a carbon source of graphite for electrode, etc., and it affords a very large amount of thermal-cracked oil. If the thermal-cracked oil is utilized effectively by the present invention, the delayed coking process will bring about a great advantage.

The compositions of the thermal-cracked oils obtained by the above-described thermal cracking processes differ according to types of the processes, thermal cracking conditions, kinds of the starting heavy oils, etc. Usually, however, those thermal-cracked oils, which scarcely contain aromatic olefins, mainly contain reactive aliphatic olefins such as n-olefins and iso-olefins in addition to n-paraffins and iso-paraffins, further contain aromatic hydrocarbons having an alkyl-substituted single ring such as alkylbenzenes or an alkyl-substituted composite ring such as alkylindanes and alkyltetralins, and however scarcely contains aromatic hydrocarbons having a condensed polycyclic aromatic ring such as alkylnaphthalenes.

Among the distillates from the thermal-cracked oils obtained in the above-described thermal cracking processes, the distillates to be processed in the present invention are those which consist mainly of hydrocarbons boiling in the range of 120° to 290° C., preferably 150° to 260° C. and which may contain at least 30 wt. % of paraffins, at least 10 wt. %, preferably at least 15 wt. %, of aliphatic olefins and a small amount of aromatic hydrocarbons. Distillates consisting mainly of hydrocarbons whose boiling range is outside the above-defined range cannot afford industrially useful liquid reaction products, and with distillates containing less than 10 wt. % of aliphatic olefins, it is impossible to recover reaction products in economical yields. Therefore, both such distillates are not desirable.

A typical composition of the distillates which may be used in the invention is 30–70 wt. % paraffins, 10–40 wt. % aliphatic olefins and 5–20 wt. % aromatic hydrocarbons. However, as long as the above-mentioned properties required of the distillates are satisfied, the thermal-cracked oils may be subjected to fractionation or diluted with unreacted oils recovered after acid treatment.

In order to modify the properties of the liquid reaction product, a fresh aromatic source may further be added. That is, according to the processing method of the present invention, in addition to the treatment of the thermal-cracked oil distillate itself with an acid catalyst, a hydrocarbon feed comprising a mixture of such thermal-cracked oil distillate and a distillate or distillates containing various aromatic hydrocarbons mainly as the aromatic source may be treated in the same manner whereby there is obtained a liquid reaction product having useful properties, for example, having a superior fluidity at low temperatures.

More specifically, the thermal-cracked oil distillate may be mixed with one or more distillates boiling in the range of 150° to 280° C., preferably 150° to 250° C., selected from the group consisting of (a) a distillate from a thermal-cracked by-product oil obtained by thermally cracking a petrolic light oil at a temperature of 750° to 850° C., (b) a reformate distillate obtained by a catalytic reforming of a petrolic light oil boiling in the range of 50° to 250° C. and (c) an aromatic distillate consisting mainly of aromatic hydrocarbons separated from the thermal-cracked by-product oil distillate of the above (a), the reformate distillate of the above (b) or a mixture thereof.

Further, if the thermal-cracked oil distillate is mixed with aromatic hydrocarbons boiling below 150° C. such as benzene, toluene, xylene and ethylbenzene, there will be obtained a useful liquid reaction product.

The thermal-cracked by-product oil distillate of the above (a) is obtained when a petrolic light oil is thermally cracked at a temperature of 750° to 850° C. with a view to producing lower olefins such as ethylene and propylene.

As examples of the petrolic light oil there are mentioned naphtha, kerosene, light oil, LPG and butane. In consideration of properties of the resultant thermal-cracked by-product oil, naphtha, kerosene and light oil are preferred as starting materials in the thermal cracking because those oils are more suitable for the objects of the present invention.

The method of thermal cracking is not specifically limited. Various conventional thermal cracking methods carried out in the temperature range of 750° to 850° C., for example, the method using a tubular cracking furnace and the method using a heat-transfer medium, can be adopted.

The above thermal-cracked by-product oil distillate obtained from the thermal-cracked product after removal of the object products which are olefins, diolefins, etc. such as ethylene, propylene and butadiene, which distillate differs depending on the kind of the starting petrolic light oil and thermal cracking conditions, is a distillate having 6 to 10 carbon atoms, containing relatively large amounts of aromatic hydrocarbons and containing 2–10 wt. % paraffins, 3–10 wt. % naphthenes, 55–85 wt. % aromatic hydrocarbons, 2–10 wt. % aliphatic olefins and 2–15 wt. % aromatic olefins, of which the distillate boiling in the range of 150° to 280° C. may be mixed with the thermal-cracked oil distillate in the present invention.

In the present invention, it is preferable to use the thermal-cracked by-product oil distillate which was subjected to a hydrogenation treatment in order to reduce unsaturation. The hydrogenation treatment may be carried out by conventional methods using a metal catalyst such as Co-Mo, Pd or Pt.

The reformate distillate of the above (b) is obtained by a catalytic reforming of a petrolic light oil boiling in the range of 50° to 280° C., e.g. a straight-run naphtha. Catalytic reforming has been widely conducted in the fields of petroleum refining and petrochemistry for improving the octane number or for obtaining benzene, toluene, xylene, etc. It is carried out using an alumina or silica-alumina supported metal catalyst such as platinum, platinum-rhenium, molybdenum oxide or chromium oxide. As industrial methods, mention may be made of the platforming of UOP Co. which is a fixed bed type and the Ultraforming of Standard Oil Co. which is also a fixed bed type. In addition fluidized bed type and moving bed type catalytic reforming methods are also employable. In the catalytic reforming, there mainly occur dehydrogenation and cyclization reaction, as well as isomerization reaction; as a result, the BTX (benzene, toluene and xylene) content increases and the octane number is improved. However, the resultant reformate has a bromine number not more than about 3.8 and thus contain very small amounts of unsaturated components.

The catalytic reformate distillate typically has 6 to 10 carbon atoms and contain 30–35 wt. % paraffins, 65–70 wt. % aromatic hydrocarbons and 0–2 wt. % olefins. The catalytic reformate distillate which may be used in the present invention has a boiling range of 150° to 280° C.

Further, the aromatic distillate of the above (c), which consists mainly of aromatic hydrocarbons, is obtained from the aforementioned catalytic reformate distillate, thermal-cracked by-product oil distillate or mixtures thereof by the use of a suitable physical separation. This separation has been performed on a large scale in the petrochemical field for obtaining BTX from catalytic reformate oils, thermal-cracked by-product oils and mixtures thereof usually according to the solvent extraction process or extractive distillation process. As typical examples of the solvent extraction process are mentioned Udex process (Dow process) which employs diethylene glycol or triethylene glycol as the extraction solvent and Sulfolane process (Shell process) which employs sulfolane as the extraction solvent. Usually, this extraction is preceded by hydrogenation to remove unsaturated components for preventing the apparatus from being blocked by polymerization of the unsaturated components.

The aromatic distillate (c) consisting mainly of aromatic hydrocarbons thus separated from the catalytic reformate distillate, the thermal-cracked by-product oil distillate or mixtures thereof consist of $C_9$ to $C_{10}$ hydrocarbons and has a boiling range of 150° to 280° C. It contains large amount of alkylbenzenes and polyalkylbenzenes, further contain small amount of naphthalene and many other aromatic hydrocarbons. However, the distillate of this boiling range has heretofore not been utilized effectively although it is obtained in a large amount together with the BTX distillate.

As to the mixing ratio, 20–95 wt. % of the thermal-cracked oil distillate from the residual oil may be mixed with 80–5 wt. % of the distillate (a), (b) and/or (c), or with 80–5 wt. % of aromatic hydrocarbons boiling at lower than 150° C. A proportion of the thermal-cracked oil distillate smaller than 20 wt. % is not desirable because the yield of the reaction product would become lower. A preferable mixing ratio is 70–90 wt. % of the thermal-cracked oil distillate and 30–10 wt. % of the distillate (a), (b) and/or (c) or the lower aromatic hydrocarbons. If the alkylbenzene content of the reaction product is to be increased, it is recommended to use the thermal-cracked oil distillate from the residual oil in a relatively small amount, e.g. 25–60 wt. %, and use 75–40 wt. % of the aromatic source.

In the process of the present invention, a hydrocarbon feed comprising the thermal-cracked oil distillate from the residual oil is treated at a reaction temperature of 0° to 300° C. in liquid phase in the presence of an acid catalyst to obtain a reaction product having a boiling range which is higher than that of said thermal-cracked oil distillate, and which is not lower than 260° C.

Preferred examples of the acid catalyst are solid acid catalysts, mineral acids, so-called Friedel-Crafts catalysts and organic acids. More concrete examples include solid acid catalysts such as acid clay minerals such as acid clay and activated clay, amorphous or crystalline silica-alumina, $AlF_3$-$Al_2O_3$ and strong acid type ion-exchange resins; Friedel-Crafts catalysts such as HF, $AlCl_3$, $BF_3$ and $SnCl_4$; and inorganic and organic acids such as sulfuric acid, p-toluenesulfonic acid and trifluoromethanesulfonic acid.

The reaction may be carried out according to any of the batch process, semi-batch process and flow process. But, in the case of using a solid acid, the flow process is preferred.

The acid catalyst is used in an amount of 0.2 to 20 wt. %, preferably 1 to 10 wt. %, based on the weight of the hydrocarbon feed in the batch process. In the flow process, it is treated at a liquid hourly space velocity (LHSV) of 0.1 to 20, preferably 0.5 to 10. The reaction temperature is in the range of 0° to 300° C., preferably 0° to 250° C., more preferably 5° to 250° C. The treating time, which differs according to reaction conditions such as the amount of catalyst, reaction temperature and the feed composition, should be long enough to complete the reaction, and usually it is selected from the range of 0.1 to 24 hours. The reaction pressure is not specifically limited if only it can maintain the reaction system in liquid phase.

The acid catalyst treatment is performed so as to give a reaction product having a boiling range not lower than 260° C., and which is higher than the boiling range of the thermal-cracked oil distillate. The reaction product consists mainly of oligomers of aliphatic olefins and alkylates of aliphatic olefins with aromatic hydrocarbons contained in the thermal-cracked oil distillate itself or derived from the other aromatic sources such as above-mentioned (a) through (c) or low boiling point aromatics. In the case where the feed is a mixture containing other distillate which contains aromatic hydrocarbons, the resultant reaction product consists mainly of alkylbenzene as alkylate. If the boiling range of the reaction product is lower than 260° C. or lower than the boiling range of the thermal-cracked oil distillate, the reaction product will be of no industrial value, and the effect of the acid catalyst treatment cannot be expected.

In the present invention, as described above, since the specific distillate from the specific source is used as a feed material and subjected to the specific treatment, a high molecular weight compound which badly affects physical properties is substantially not produced, and the reaction product obtained is a liquid product having a relatively low viscosity, for example, in the range of 3 to 30 cSt at 75° C. Therefore, after the acid catalyst treatment, unreacted distillate (the starting thermal-cracked oil distillate), and unreacted other distillate or lower aromatic hydrocarbons which are mixed to said thermal-cracked oil distillate, are separated by a physical separation such as distillation, and then the reaction product can be put to practical use without the necessity of further separating heavier compounds. Of course, the reaction product may be divided into fractions of suitable boiling ranges according to purposes of use, etc.

As a result of the above-mentioned treatment, the content of unsaturated component of the thermal-cracked oil distillate is reduced, for example, the bromine number thereof is decreased, but the reaction product contains, particularly its relatively high-boiling point oligomers of aliphatic olefins as previously noted, so it is preferable that the content of olefinically unsaturated components be decreased or made substantially zero by a catalytic hydrogenation treatment to improve electrical characteristics. It goes without saying that this catalytic hydrogenation is carried out under the condition that the hydrogenation of aromatic ring is no substantially occurred as well known by those skilled in the art. This catalytic hydrogenation treatment may be applied to any of the separated reaction product, distillate which contains a large amount of the reaction product and the thermal-cracked oil distillate itself which has been subjected to the acid catalyst treatment.

In the catalytic hydrogenation treatment there may be used any conventional catalyst. For example, metallic catalysts such as Pt, Pd, Ni, Co, Mo, W, Co-Mo and Ni-W are employable. The catalytic hydrogenation treatment is carried out usually under the conditions of a reaction temperature in the range of 250° to 400° C., a hydrogen pressure in the range of 20 to 100 kg/cm$^2$, a hydrogen/oil mole ratio in the range of 0.5 to 20 and an LHSV in the range of 0.1 to 10.

After the catalytic hydrogenation treatment, the hydrogenated reaction product, and gases if required, are separated by any suitable means such as distillation. Of course, the hydrogenated reaction product may be further separated into fractions according to purposes of use. The reaction product or the hydrogenated reaction product thus obtained has a boiling range not lower than 260° C., a kinetic viscosity not higher than 30 cSt at 75° C., a pour point not higher than −40° C. and a flash point not lower than 140° C. As to its composition, although the quantitative relation varies, depending on the kind of the starting petrolic heavy oil, thermal cracking conditions and the blending ratio of the aromatic distillate, the hydrogenated reaction product, which scarcely contains n-paraffins, mainly contains iso-paraffins and aromatic hydrocarbons containing alkyl-substituted single or composite rings.

The reaction product thus obtained has a good color and a reduced content of impurities such as sulfur and metal. It is sufficiently employable as an electrical insulating oil.

The electrical insulating oil of the present invention is inexpensive and has excellent low temperature characteristics and accordingly can be widely used as an electric cable oil, transformer oil and the like. The electrical insulating oil of the present invention can be used together with one or more conventional electrical insulating oils such as mineral oil or alkylbenzene, e.g. dodecyl benzene.

The following examples are given to further illustrate the presen invention.

EXAMPLE 1

From a delayed coking apparatus (cracking conditions: temperature of 496° C., residence time of 24 hours, pressure of 4 kg/cm$^2$) for coking a residual oil in vacuum distillation of such properties as shown in Table 1 obtained from Minus crude oil there was obtained a thermal-cracked oil in addition to gases and coke as shown in Table 2. The feed distillate used from this thermal-cracked oil was of such a composition as shown in Table 3.

TABLE 1

| Properties of the heavy residual oil | Minus vacuum-distilled bottom residue |
|---|---|
| Specific gravity (@ 15° C.), API | 20 |
| Asphaltene, wt. % | 2.6 |
| Conradson residual carbon, wt. % | 7.1 |

TABLE 2

| Yield | (wt. %) |
|---|---|
| Starting oil | 100 |
| Butane and light gas | 8 |
| 30–160° C. (Distillate No. 1) | 13 |
| 160–260° C. (Distillate No. 2) | 22 |
| 260° C.$^+$ (Distillate No. 3) | 40 |
| Coke | 17 |

TABLE 3

| Feed Composition | (Distillate No. 2) 160–260° C. |
|---|---|
| Bromine number, cg/g | 20.2 |
| Type analysis (wt. %) | |
| Paraffins | 68.3 |
| Aliphatic olefins | 19.4 |
| Aromatics | 12.3 |
| Aromatic olefins | — |
| | Total 100 |

Then, 40 g. of $AlCl_3$ was added to 4 l of distillate No. 2 followed by treatment at 50° C. for 20 hours according to the batch process. Thereafter, the reaction mixture was treated with aqueous ammonia for neutralization and decomposition of $AlCl_3$, which was removed by washing with water. Subsequent dehydration and distillation afforded a reaction product (870 g., 29% yield) as a 340° C.+ distillate. This reaction product was found to have a bromine number of 6.4 cg/g and an aromatic content of 78.7%, most of the balance were olefins.

The reaction product was then subjected to a hydrogenation treatment using a Co-Mo catalyst under the conditions of a hydrogen pressure of 50 kg/cm$^2$, a reaction temperature of 280° C. and one volume feed oil/catalyst volume/hr.

After the hydrogenation, the light fraction formed by decomposition was distilled off, and the hydrogenated reaction products was recovered. The percent recovery was 92%. It proved to have a bromine number of 0.34 cg/g and an aromatics content of 76.6%.

Further, the nuclei of aromatic hydrocarbons were substantially not hydrogenated.

Table 4 below shows physical properties of the hydrogenated reaction product as well as results of electrical characteristic tests conducted in accordance with ASTM D-1934 and oxidation stability tests conducted in accordance with JIS C2101. Results obtained using mineral oil are also set out in the same table for comparison. From the results shown in Table 4 it is apparent that the hydrogenated reaction product has superior physical properties even in comparison with the mineral oil and is therefore very suitable as an insulating oil.

TABLE 4

| | Hydrogenated Reaction Product | Mineral Oil |
|---|---|---|
| Kinetic Viscosity (@ 75° C., cSt) | 10.2 | 3.1 |
| Pour Point (°C.) | −47.5 | −30 |
| Flash Point (°C.) | 202 | 132 |
| Electrical characteristics (heat deterioration) | | |
| Dielectric loss tangent (%, @ 80° C.) | | |
| Before deterioration | 0.001 | 0.001 |
| After deterioration (without catalyst) | 0.015 | 0.194 |
| After deterioration (with catalyst) | 0.066 | 2.323 |
| Volume resistivity (Ω cm, @ 80° C.) | | |
| Before deterioration | $3.7 \times 10^{16}$ | $6.3 \times 10^{15}$ |
| After deterioration (without catalyst) | $2.1 \times 10^{14}$ | $2.5 \times 10^{13}$ |
| After deterioration (with catalyst) | $9.6 \times 10^{13}$ | $1.3 \times 10^{12}$ |
| Oxidation Stability | | |
| Sludge (%) | 0.04 | 0.10 |
| Total acid number (mgKOH/g) | 0.12 | 0.50 |

EXAMPLE 2

40 ml. of $BF_3.H_2O$ was added to 4 l of distillate No. 2 in Table 2 obtained in Example 1 followed by treatment at 50° C. for 2 hours according to the batch process. Then, the reaction mixture was treated with an aqueous ammonia for neutralization of the catalyst, which was removed by washing with water. After a sufficient dehydration, 690 g. of reaction product was recovered by distillation as a 350° C.+ distillate. The reaction product proved to have a kinetic viscosity of 10.2 cSt (@75° C.), a pour point of −47.5° C. and a flash point of 200° C.

EXAMPLE 3

The Minus vacuum-distilled bottom residue described in Example 1 was subjected to a thermal cracking under the conditions of a temperature of 485° C., a pressure of 1.5 kg/cm$^2$ and a residence time of 1.5 hours. The resultant thermal-cracked oil was rectified to obtain a thermal-cracked oil distillate having a boiling range of 100° to 300° C. (containing 85% components boiling in the range of 120° to 290° C.). The yield was 37%.

The thermal-cracked oil distillate was treated using a silica-alumina catalyst according to the fixed-bed flow process under the conditions of a reaction temperature of 200° C. and one volume feed oil/catalyst volume/hr. The reaction solution was subjected to a catalytic hydrogenation treatment using a Co-Mo catalyst under the conditions of a hydrogen pressure of 50 kg/cm$^2$, a reaction temperature of 300° C., one volume feed oil/catalyst volume/hr and an $H_2$/oil mole ratio of 10, to obtain a hydrogenated reaction product having a boiling range beyond 330° C., a kinetic viscosity of 5.4 cSt (@75° C.), a pour point of −52.5° C. and a flash point of 152° C.

The hydrogenated reaction product was tested fo electrical characteristics and oxidation stability The results are shown in Table 5.

Additionally, the reaction product of 350° C.+ obtained in Example 2 was hydrogenated in the same manner. The tested results of this hydrogenated reaction product are also shown in Table 5.

TABLE 5

| | Example 2 | Example 3 |
|---|---|---|
| Kinetic Viscosity (@ 75° C., cSt) | 10.0 | 5.4 |
| Pour Point (°C.) | −50 | −52.5 |
| Flash Point (°C.) | 205 | 152 |
| Electrical characteristics | | |
| Dielectric breakdown boltage (KV/2.5 mm) | more than 60 | more than 60 |
| Dielectric loss tangent (%, @ 80° C.) | | |
| Before deterioration | 0.001 | 0.001 |
| After deterioration (without catalyst) | 0.016 | 0.014 |
| After deterioration (with catalyst) | 0.057 | 0.060 |
| Volume resistivity (Ω cm, @ 80° C.) | | |
| Before deterioration | $3.5 \times 10^{16}$ | $3.1 \times 10^{16}$ |
| After deterioration (without catalyst) | $2.7 \times 10^{14}$ | $2.0 \times 10^{14}$ |
| After deterioration (with catalyst) | $9.9 \times 10^{13}$ | $9.1 \times 10^{13}$ |
| Oxidation Stability | | |
| Sludge (%) | 0.05 | 0.03 |
| Total acid number (mgKOH/g) | 0.13 | 0.12 |
| Corrosive sulfur test 140° C. × 19 hrs. | no corrosion | no corrosion |

EXAMPLE 4

A by-product oil distillate having a boiling range of 61° to 250° C. was distilled out from a tubular thermal cracking furnace for thermal cracking of naphtha at 780° C. to 810° C. for the production of ethylene and propylene. The by-product oil distillate contained large amounts of aromatic hydrocarbons such as benzene, toluene, xylene and styrene in addition to acetylenes and diolefins.

Then, the distillate was subjected to a hydrogenation treatment using a Unifining two-stage hydrogenation apparatus for the removal of unsaturated components such as diolefins and for desulfurization. As a catalyst there was used a cobalt-molybdenum catalyst supported on alumina. The hydrogenation conditions were a temperature of 220° C. and a pressure of 50 kg/cm$^2$ in the first stage and 330° C. and 50 kg/cm$^3$ in the second stage.

The thermal-cracked by-product oil distillate thus hydrogenated proved to have a sulfur content of 0.01% and an unsaturated components content not higher than 0.01%. This distillate will be hereinafter referred to as distillate (a).

In the next place, a reformate was obtained from a platforming apparatus for a catalytic reforming of naphtha having a boiling range of 50° to 250° C. by the use of a platinum catalyst in the presence of hydrogen at a reaction temperature of 470° C. and pressure of 50 kg/cm$^2$ for the production of gasoline and benzene, toluene or xylene. This reformate also contained large amounts of aromatics, but had a less content of unsaturated components than that of the foregoing thermal-cracked by-product oil distillate. It will hereinafter be referred to as distillate (b).

Then, 90 vol. % of the reformate distillate (b) having a boiling range of 60° to 250° C. was mixed with 10 vol. % of a fraction having the same boiling range from the distillate (a) (thermal-cracked by-product oil distillate), and the mixture was fed to a Udex extractor to recover an aromatics distillate. More specifically, the mixture was fed to the middle portion of an aromatics extraction column, while ethylene glycol as an extraction solvent was fed from the top of the column, and thus a countercurrent extraction was performed. After refining of the extract, there were produced benzene, toluene, xylene and ethylbenzene by fractionation. At this time, an aromatic distillate having a boiling range of 150° to 250° C. was by-produced as a distillate of $C_9$ or more. This aromatics distillate, containing 99% or more aromatics, will be hereinafter referred to as distillate (c). Table 6 below shows properties of a fraction (distillate (c')) having a boiling range of 160° to 180° C. from the distillate (c).

TABLE 6

| Properties | Boiling Range 160°-180° C. (distillate (c')) |
|---|---|
| Specific gravity @ 60° F./60° F. | 0.876 |
| Saybolt color | above +30 |
| Flash point (PMCC) | 45 |
| Blended aniline point, °C. | 13 |
| Aromatics (vol. %) | 99.5 |
| Distillation property (ASTM) | |
| Initial boiling point, °C. | 160 |
| Dry point, °C. | 176 |

Table 7 below shows the composition of the thus-extracted xylene distillate (c'') having a boiling range of 135° C. to 145° C.

TABLE 7

| Composition of xylene distillate (c'') | |
|---|---|
| Component Name | Mixing Ratio |
| Ethylbenzene | 55.8 wt. % |
| p-Xylene | 10.4 wt. % |

TABLE 7-continued

| Composition of xylene distillate (c'') | |
|---|---|
| Component Name | Mixing Ratio |
| m-Xylene | 20.7 wt. % |
| o-Xylene | 11.8 wt. % |
| Others | 1.3 wt. % |

5 g. of $AlCl_3$ was added to a mixture (containing 17.5% aliphatic olefins) consisting of 450 ml. of the distillate No. 2 (thermal-cracked oil distillate) obtained in Example 1 and 50 ml. of the distillate (c') (aromatics distillate followed by treatment at 185° C. for 1.5 hours according to the batch process. Thereafter, the reaction mixture was treated with an aqueous ammonia for neutralization and decomposition of $AlCl_3$. Subsequent dehydration afforded 98.4 g. (24.4% yield) of reaction product as a 315° C.+ distillate. The reaction product proved to have a bromine number of 5.6 cg/g and an aromatics content of 80.2%. The balance were almost olefins. Further, the reaction product was found to have a kinetic viscosity of 10.4 cSt (@75° C.), a pour point of −47.5° C. and a flash point of 180° C.

Then, the reaction product was subjected to a hydrogenation treatment using a Co-Mo catalyst under the conditions of a reaction temperature of 260° C., a hydrogen pressure of 50 kg/cm$^2$ and one volume reaction mixture/catalyst volume/hr. Thereafter, the light fraction formed by decomposition was distilled off and the hydrogenated reaction product was recovered at a percent recovery of 81.1%. The reaction product thus hydrogenated had a bromine number of 0.3 cg/g and an aromatics content of 78.5%.

The nuclei of aromatic hydrocarbons were substantially not hydrogenated.

Table 8 shows physical properties of the hydrogenated reaction product as well as results of electrical characteristic tests conducted in accordance with ASTM D-1934 and oxidation stability tests conducted in accordance with JIS C2102. From the results shown in Table 8 it is apparent that the hydrogenated reaction product obtained according to the process of the present invention has superior physical properties as compared with mineral oil and is therefore best suited for use as an insulating oil.

TABLE 8

| | |
|---|---|
| Kinetic Viscosity (@ 75° C., cSt) | 9.1 |
| Pour point (°C.) | −47.5 |
| Flash point (°C.) | 180 |
| Electrical characteristics (heat deterioration) | |
| Dielectric loss tangent (%, @ 80° C.) | |
| Before deterioration | 0.001 |
| After deterioration (without catalyst) | 0.017 |
| After deterioration (with catalyst) | 0.066 |
| Volume resistivity (Ω cm, @ 80° C.) | |
| Before deterioration | $7.0 \times 10^{16}$ |
| After deterioration (without catalyst) | $3.2 \times 10^{14}$ |
| After deterioration (with catalyst) | $1.0 \times 10^{14}$ |
| Oxidation Stability | |
| Sludge (%) | 0.05 |
| Total acid number (mgKOH/g) | 0.11 |

EXAMPLE 5

5 g. of $AlCl_3$ was added to a mixture (containing 18.4% olefins) consisting of 475 ml. of the distillate No. 2 (thermal-cracked oil distillate) obtained in Example 1 and 25 ml. of the distillate (c') (aromatics distillate obtained in Example 4) followed by treatment at 185° C. for 1.5 hours according to the batch process. Thereafter, the reaction mixture was treated with an aqueous ammonia for neutralization of the catalyst, which catalyst was removed by washing with water. After a sufficient dehydration there was obtained 96.4 g. (24.0% yield) of reaction mixture as a 315° C.+ distillate. This product proved to have a kinetic viscosity of 10.6 cSt (@75° C.), a pour point of −47.5° C. and a flash point of 180° C. Electrical characteristics and oxidation stability of the product after refining by hydrogenation were of about the same values as in Example 1.

EXAMPLE 6

5 g. of $AlCl_3$ was added to a mixture (containing 9.7% olefins) consisting of 250 ml. of the distillate No. 2 (thermal-cracked oil distillate) obtained in Example 1 and 250 ml. of the distillate (c') (aromatics distillate obtained in Example 4) followed by treatment at 185° C. for 1.5 hours according to the batch process. Thereafter, the reaction mixture was treated with an aqueous ammonia for neutralization of the catalyst, which catalyst was removed by washing with water. After a sufficient dehydration there was obtained 43.2 g. (10.4% yield) of reaction mixture as a 315° C.+ distillate. This product proved to have a kinetic viscosity of 6.5 cSt (@75° C.), a pour point of −50° C. and flash point of 180° C.

EXAMPLE 7

5 g. of $AlCl_3$ was added to a mixture (containing 4.0% olefins) consisting of 100 ml. of the distillate No. 2 (thermal-cracked oil distillate) obtained in Example 1 and 400 ml. of the distillate (c') (aromatics distillate obtained in Example 4) followed by treatment in the same way as in Example 1 to obtain 27.1 g. (6.4% yield) of reaction mixture as a 315° C.+ distillate. This product proved to have a viscosity of 4.0 cSt (@75° C.), a pour point of −50° C. and a flash point of 180° C.

EXAMPLE 8

5 g. of $AlCl_3$ was added to a mixture (containing 17.5% olefins) consisting of 450 ml. of the distillate No. 2 (thermal-cracked oil distillate) obtained in Example 1 and 50 ml. of the distillate (c) obtained in Example 4, followed by treatment at 185° C. for 1.5 hours according to the batch process. Thereafter, the reaction mixture was treated with an aqueous ammonia for neutralization of the catalyst, which catalyst was removed by washing with water. After a thorough dehydration there was obtained 97.2 g. (24.3% yield) of reaction mixture as a 315° C.+ distillate. This product proved to have a viscosity of 11.6 cSt (@75° C.), a pour point of −42.5° C. and a flash point of 190° C.

EXAMPLE 9

5 g. of $AlCl_3$ was added to a mixture (containing 18.7% olefins) consisting of 450 ml. of the distillate No. 2 (thermal-cracked oil distillate) obtained in Example 1 and 50 ml. of a fraction having a boiling range of 150° to 250° C. from the distillate (a) (thermal-cracked by-product oil distillate) obtained in Example 4 followed by treatment at 185° C. for 1.5 hours according to the batch process. Thereafter, the reaction mixture was treated with an aqueous ammonia for neutralization of the catalyst, which catalyst was removed by washing with water. After a thorough dehydration there was obtained 97.2 g. (24.1% yield) of reaction mixture as a 315° C. distillate. This product proved to have a kinetic viscosity of 12.1 cSt, a pour point of −42.5° C. and a flash point of 186° C.

EXAMPLE 10

5 g. of $AlCl_3$ was added to a mixture (containing 17.8% olefins) consisting of 450 ml. of the distillate No. 2 (thermal-cracked oil distillate) obtained in Example 1 and 50 ml. of a fraction having a boiling range of 150° to 250° C. from the distillate (b) (reformate distillate) obtained in Example 4 followed by treatment at 185° C. for 1.5 hours according to the batch process. Thereafter, the reaction mixture was treated with an aqueous ammonia for neutralization of the catalyst, which catalyst was removed by washing with water. After a thorough dehydration there was obtained 95.3 g. (23.6% yield) of reaction mixture as a 315° C.+ distillate. This product proved to have a kinetic viscosity of 11.6 cSt, a pour point of −45° C. and a flash point of 190° C.

EXAMPLE 11

5 ml. of $BF_3.H_2O$ was added to a mixture (containing 17.5% olefins) consisting of 450 ml. of the distillate No.2 (thermal-cracked oil distillate) obtained in Example 1 and 50 ml. of the distillate (c') (aromatic distillate) obtained in Example 4 followed by treatment at 90° C. for 5 hours according to the batch process. Thereafter, the reaction mixture was treated with an aqueous ammonia for neutralization of the catalyst, which catalyst was removed by washing with water. After a thorough dehydration there was obtained 72 g. (17.8% yield) of reaction product as a 315° C.+distillate. This product proved to have a kinetic viscosity of 7.2 cSt (@75° C.), a pour point of −50° C. and a flash point of 180° C.

EXAMPLE 12

The Minus vacuum-distilled bottom residue described in Example 1 was thermally cracked under the conditions of a temperature of 485° C., a pressure of 1.5 $kg/cm^2$ and a residence time of 1.5 hours, and the resultant thermal-cracked oil was rectified to obtain a thermal-cracked oil distillate having a boiling range of 100° to 300° C. (containing 85% components boiling in the range of 120° to 290° C.). The yield was 37%.

A mixture (containing 18.0% olefins) consisting of 450 ml. of the thermal-cracked oil distillate just obtained above and 50 ml. of the distillate (c') (aromatics distillate) obtained in Example 4 was treated using a silica-alumina catalyst according to the fixed-bed flow process under the conditions of a reaction temperature of 200° C. and one volume feed oil/catalyst volume/hr.

The reaction solution was subjected directly to a catalytic hydrogenation treatment under the conditions of a reaction temperature of 300° C., a hydrogen pressure of 50 $kg/cm^2$, one volume feed oil/catalyst volume hr and $H_2$/oil moler atio of 10, to obtain a reaction product as a 315° C.+distillate having a kinetic viscosity of 5.2 cSt (@75° C.), a pour point of −52.5° C. and a flash point of 160° C.

The nuclei of the aromatic hydrocarbons were not substantially hydrogenated.

Then, the hydrogenated reaction product was tested for electrical characteristics and oxidation stability. The results are shown in Table 9.

Additionally, the reaction products obtained in Example 5 through 11 were hydrogenated respectively in the same manner as above. The tested results of those hydrogenated reaction products are also shown in Table 9.

TABLE 9

| | Hydrogenated reaction products | | | | | | | |
|---|---|---|---|---|---|---|---|---|
| | Example No. | | | | | | | |
| | 5 | 6 | 7 | 8 | 9 | 10 | 11 | 12 |
| Kinetic Viscosity (@ 75° C., cSt) | 9.7 | 6.3 | 3.9 | 11.1 | 12.0 | 11.1 | 7.2 | 5.2 |
| Pour Point (°C.) | −47.5 | −50 | −50 | −42.5 | −42.5 | −42.5 | −50 | −52.5 |
| Flash Point (°C.) | 180 | 180 | 180 | 190 | 185 | 190 | 180 | 160 |
| Electrical characteristics | | | | | | | | |
| Dielectric breakdown boltage (KV/2.5 mm) | more than 60 | | more than 60 | | more than 60 | | more than 60 | |
| Dielectric loss tangent (%, @ 80° C.) | | | | | | | | |
| Before deterioration | 0.001 | 0.001 | 0.001 | 0.001 | 0.001 | 0.001 | 0.001 | 0.001 |
| After deterioration (without catalyst) | 0.015 | 0.013 | 0.019 | 0.017 | 0.014 | 0.018 | 0.015 | 0.016 |
| After deterioration (with catalyst) | 0.065 | 0.066 | 0.065 | 0.067 | 0.069 | 0.067 | 0.069 | 0.063 |
| Volume resistivity (Ω cm, @ 80° C.) | | | | | | | | |
| Before deterioration | $7.1 \times 10^{16}$ | $7.2 \times 10^{16}$ | $1.0 \times 10^{16}$ | $6.9 \times 10^{16}$ | $7.3 \times 10^{16}$ | $7.2 \times 10^{16}$ | $6.8 \times 10^{16}$ | $7.5 \times 10^{16}$ |
| After deterioration (without catalyst) | $3.1 \times 10^{14}$ | $3.6 \times 10^{14}$ | $3.0 \times 10^{14}$ | $3.9 \times 10^{14}$ | $4.2 \times 10^{14}$ | $4.0 \times 10^{14}$ | $3.7 \times 10^{14}$ | $3.1 \times 10^{14}$ |
| After deterioration (with catalyst) | $1.5 \times 10^{14}$ | $1.7 \times 10^{14}$ | $2.0 \times 10^{14}$ | $1.3 \times 10^{14}$ | $1.9 \times 10^{14}$ | $1.6 \times 10^{14}$ | $1.5 \times 10^{14}$ | $1.9 \times 10^{14}$ |
| Oxidation Stability | | | | | | | | |
| Sludge (%) | 0.04 | 0.03 | 0.05 | 0.06 | 0.03 | 0.04 | 0.07 | 0.06 |
| Total acid number (mgKOH/g) | 0.11 | 0.14 | 0.10 | 0.16 | 0.14 | 0.13 | 0.17 | 0.15 |
| Corrosive sulfur test 140° C. × 19 hrs. | no corrosion | | no corrosion | | no corrosion | | no corrosion | |

EXAMPLE 13

8.4 g. of anhydrous aluminum chloride was added to a mixture (containing 7.4% olefins) consisting of 400 ml. of the distillate No. 2 (thermal-cracked oil distillate) obtained in Example 1 and 600 ml. of the xylene distillate (c″) obtained in Example 4 followed by treatment at 130° C. for 1 hour according to the batch process. Thereafter, the reaction mixture was treated with an aqueous ammonia for neutralization and decomposition of the catalyst. Subsequent dehydration afforded 79.4 g. (9.5% yield) of reaction product as a 260° C.+ distillate. The reaction product proved to have a bromine number of 1.0 cg/g and an aromatics content of 98%. Most of the balance were olefins. Further, this product had a kinetic viscosity of 5.3 cSt (@75° C.), a pour point of −50° C. and a flash point of 172° C.

Then, the reaction product was subjected to a hydrogenation treatment using a Co-Mo catalyst under the condition of a hydrogen pressure of 50 kg/cm$^2$, a reaction temperature of 260° C. and one volume reaction mixture/catalyst volume/hr. Thereafter, the light fraction formed by decomposition was distilled off and the hydrogenated reaction product was recovered at a percent recovery of 98%. The reaction product thus hydrogenated had a bromine number of 0.3 cg/g and an aromatics contents of 99%. The nuclei of the aromatic hydrocarbons were not substantially hydrogenated.

Table 10 shows physical properties of the hydrogenated reaction product as well as results of the electrical characteristic tests conducted in accordance with ASTM D-1934 and oxidation stability tests conducted in accordance with JIS C2102.

EXAMPLE 14

8.4 g. of anhydrous aluminum chloride was added to a mixture (containing 7.4% olefins) consisting of 400 ml. of the distillate No. 2 (thermal-cracked oil distillate) obtained in Example 1 and 600 ml. of benzene followed by treatment at 80° C. for 1 hour according to the batch process. Thereafter, the reaction mixture was treated with an aqueous ammonia for neutralization of the catalyst, which catalyst was removed by washing with water. After a thorough dehydration there was obtained 72.7 g. (8.7% yield) of reaction product as a 260° C.+ distillate having a kinetic viscosity of 5.7 cSt (@75° C.), a pour point of −50° C. and a flash point of 154° C.

EXAMPLE 15

8.4 g. of anhydrous aluminum chloride was added to a mixture (containing 18.4% olefins) consisting of 950 ml. of the distillate No. 2 (thermal-cracked oil distillate) obtained in Example 1 and 50 ml. of benzene followed by treatment at 100° C. for 1 hour according to the batch process. Thereafter, the reaction mixture was treated with an aqueous ammonia for neutralization of the catalyst, which catalyst was removed by washing with water. After a thorough dehydration there was obtained 192 g. (23.9% yield) of reaction product as a 260° C.+ distillate having a kinetic viscosity of 13.1 cSt (@75° C.), a pour point of −42.5° C. and a flash point of 164° C.

EXAMPLE 16

300 ml. of benzene and 600 ml. of anhydrous hydrogen fluoride (purity: 99% or higher) were charged into a batch process reactor (content volume 5 l) cooled at 5° C. and allowed to cool sufficiently with stirring, then a mixture consisting of 300 ml. of benzene and 400 ml. of the fraction having a boiling range of 160°-220° C. from the distillate No. 2 (thermal-cracked oil distillate) obtained Example 1 was added dropwise over a period of 10 minutes. The stirring was continued for another one hour. Thereafter, the reaction mixture was allowed to stand for separation into oil layer and anhydrous hydrogen fluoride layer. Then, the oil layer was treated with a 10 wt. % potassium hydroxide solution for neutralization and decomposition of the anhydrous hydrogen fluoride incorporated therein, which hydrogen fluoride was removed by washing with water. After a thorough dehydration there was obtained 85.3 g. (10.2% yield) of reaction product having a boiling range beyond 260° C., a kinetic viscosity of 3.5 cSt (@75° C.), a pour point of below −55° C. and a flash point of 144° C.

The reaction product obtained in above Examples 14 through 16 were also hydrogenated in a same manner as Example 13, respectively.

The tests results are shown in Table 10 below.

TABLE 10

| | Hydrogenated reaction products | | | |
|---|---|---|---|---|
| | Example No. | | | |
| | 13 | 14 | 15 | 16 |
| Kinetic Viscosity (@ 75° C., cSt) | 4.8 | 5.2 | 12.2 | 3.3 |
| Pour Point (°C.) | −50 | −50 | −45 | below −55 |
| Flash Point (°C.) | 172 | 154 | 168 | 145 |
| Electrical characteristics | | | | |
| Dielectric breakdown boltage (KV/2.5 mm) | more than 60 | more than 60 | more than 60 | more than 60 |
| Dielectric loss tangent (%, @ 80° C.) | | | | |
| Before deterioration | 0.001 | 0.001 | 0.001 | 0.001 |
| After deterioration (without catalyst) | 0.017 | 0.015 | 0.018 | 0.016 |
| After deterioration (with catalyst) | 0.066 | 0.070 | 0.068 | 0.069 |
| Volume resistivity (Ω cm, @ 80° C.) | | | | |
| Before deterioration | $7.0 \times 10^{16}$ | $6.8 \times 10^{16}$ | $6.7 \times 10^{16}$ | $6.5 \times 10^{16}$ |
| After deterioration (without catalyst) | $3.2 \times 10^{14}$ | $2.7 \times 10^{14}$ | $3.0 \times 10^{14}$ | $2.9 \times 10^{14}$ |
| After deterioration (with catalyst) | $1.0 \times 10^{14}$ | $9.3 \times 10^{13}$ | $9.1 \times 10^{13}$ | $9.5 \times 10^{13}$ |
| Oxidation Stability | | | | |
| Sludge (%) | 0.05 | 0.06 | 0.08 | 0.07 |
| Total acid number (mgKOH/g) | 0.11 | 0.16 | 0.19 | 0.17 |
| Corrosive sulfur test 140° C. × 19 hrs. | no corrosion | | no corrosion | |

What is claimed is:

1. An electrical insulating oil comprising a reaction product having a boiling range of higher than 260° C., a kinetic viscosity not higher than 30 cSt at 75° C. and a pour point not higher than −40° C., obtained by treating a hydrocarbon feed at a reaction temperature in the range of 0° to 300° C. in liquid phase with an acid catalyst, said hydrocarbon feed comprising a first distillate from a thermal-cracked oil obtained in a process of a delayed coking of a petrolic heavy residual oil at a temperature not lower than 400° C. and not exceeding 600° C., said first distillate consisting mainly of hydrocarbons boiling in the range of 120° to 290° C. and said first distillate containing at least 30 weight percent of paraffins, at least 10 weight percent of aliphatic olefins and 5–20 weight % of aromatic hydrocarbons, and separating by distillation said reaction product from the resulting mixture containing at least said reaction product and unreacted hydrocarbons, and said boiling range of said reaction product being higher than the boiling range of said unreacted hydrocarbons.

2. An electrical insulating oil according to claim 1 wherein said distillate from the thermal-cracked oil contains an amount of aromatic hydrocarbons which is inherent to a first distillate of a delayed coking of a petrolic heavy residual oil at a temperature not lower than 400° C. and not exceeding 600° C.

3. An electrical insulating oil according to claim 1 wherein said hydrocarbon feed is a mixture of:

(I) 70–90 weight percent of said first distillate; and (II) 30–10 weight percent of one or more second distillates boiling in the range of 150° to 280° C. and selected from the group consisting of the following (a) through (c) second distillates:

(a) a thermal-cracked by-product oil distillate obtained by thermal cracking of a petrolic light oil at a cracking temperature in the range of 750° to 850° C.;

(b) a reformate distillate obtained by catalytic reforming of a petrolic light oil boiling in the range of 50° to 250° C.; and (c) an aromatic hydrocarbon distillate consisting mainly of aromatic hydrocarbons and obtained by separation from said thermal-cracked by-product oil distillate (a), said reformate distillate (b) or a mixture thereof.

4. An electrical insulating oil according to claim 1 wherein said acid catalyst is aluminum chloride, boron fluoride, their complex, hydrogen fluoride or silica-alumina.

5. An electrical insulating oil according to claim 3 wherein (c) an aromatic hydrocarbon distillate consisting mainly of aromatic hydrocarbons is obtained by a solvent extraction or extractive distillation from said thermal-cracked by-product oil distillate (a), said reformate distillate (b) or a mixture thereof.

6. An electrical insulating oil comprising a hydrogenated reaction product having a boiling range of higher than 260° C., a kinetic viscosity not higher than 30 cSt at 75° C. and a pour point not higher than −40° C., obtained by treating a hydrogen feed at a reaction temperature in the rage of 0° to 300° C. in liquid phase with an acid catalyst, said hydrocarbon feed comprising a first distillate from a thermal-cracked oil obtained in a process of a delayed coking of a petrolic heavy residual oil at a temperature not lower than 400° C. and not exceeding 600° C., said first distillate consisting mainly of hydrocarbons boiling in the range 120° to 290° C. and said first distillate containing at least 30 weight percent of paraffins, at least 10 weight percent of aliphatic olefins and 5–20 weight % of aromatic hydrocarbons, separating a reaction product having a boiling range of higher than 260° C. from the resulting mixture containing at least said reaction product and unreacted hydrocarbons, and selectively hydrogenating olefinic unsaturation values present in said reaction product.

7. An electrical insulating oil according to claim 6 wherein said distillate from the thermal-cracked oil contains an amount of aromatic hydrocarbons which is inherent to a first distillate of a delayed coking of a petrolic heavy residual oil at a temperature not lower than 400° C. and not exceeding 600° C.

8. An electrical insulating oil according to claim 6 wherein said hydrocarbon feed is a mixture of:

(I) 70–90 weight percent of said first distillate; and (II) 30–10 weight percent of one or more second distillates boiling in the range of 150° to 280° C. and selected from the group consisting of the following (a) through (c) second distillates (a) a thermal-cracked by-product oil distillate obtained by thermal cracking of a petrolic light oil at a cracking temperature in the range of 750° to 850° C.;

(b) a reformate distillate obtained by catalytic reforming of a petrolic light oil boiling in the range of 50° to 250° C.; and (c) an aromatic hydrocarbon distillate consisting mainly of aromatic hydrocarbons and obtained by separation from said thermal-cracked by-product oil distillate (a), said reformate distillate (b) or a mixture thereof.

9. An electrical insulating oil according to claim 6 wherein said acid catalyst is aluminum chloride, boron fluoride, their complex, hydrogen fluoride or silica-alumina.

10. An electrical insulating oil according to claim 8 wherein said II (c) second distillate consisting mainly of aromatic hydrocarbons is obtained by a solvent extraction or extractive distillation from said thermal-cracked by-product oil distillate (a), said reformate distillate (b) or a mixture thereof.

11. An electrical insulating oil according to claim 1 wherein said first distillate consists essentially of 30–70 weight % paraffins, 10–40 weight % aliphatic olefins and 5–20 weight % aromatic hydrocarbons.

12. An electrical insulating oil according to claim 6 wherein said first distillate consists essentially of 30–70 weight % paraffins, 10–40 weight % aliphatic olefins and 5–20 weight % aromatic hydrocarbons.

13. An electrical insulating oil according to claim 1 wherein said hydrocarbon feed is a mixture of:

(I) 70–90 weight percent of said first distillate; and (II) (c) 30–10 weight percent of an aromatic hydrocarbon selected from the group consisting of benzene, toluene, xylene, ethylbenzene and a mixture thereof.

14. An electrical insulating oil according to claim 6 wherein said hydrocarbon feed in a mixture of:

(I) 70–90 weight percent of said first distillate; and (II) (c) 30–10 weight percent of an aromatic hydrocarbon selected from the group consisting of benzene, toluene, xylene, ethylbenzene and a mixture thereof.

* * * * *